United States Patent [19]

Phillips et al.

[11] 4,113,316

[45] Sep. 12, 1978

[54] FUNNELING MACHINE WITH INCLINED ADVANCING RAMS

[75] Inventors: Reginald Andrew Phillips, Skelmersdale; Terence Hamilton, Wigan; Arthur David Thompson, Chorley, all of England

[73] Assignee: Dobson Park Industries Limited, Nottingham, England

[21] Appl. No.: 734,637

[22] Filed: Oct. 15, 1976

[30] Foreign Application Priority Data

Oct. 15, 1975 [GB] United Kingdom ..... 42122/75

[51] Int. Cl.[2] ..... E21D 9/10

[52] U.S. Cl. ..... 299/31; 173/46; 296/64; 299/67

[58] Field of Search ..... 299/18, 31, 64, 67, 299/65, 66; 173/46

[56] References Cited

U.S. PATENT DOCUMENTS

| | | | |
|---|---|---|---|
| 2,980,409 | 4/1961 | Goodrich | 299/66 X |
| 3,032,325 | 5/1962 | Peterson | 299/67 |
| 3,345,108 | 10/1967 | Newman et al. | 299/31 |
| 3,809,169 | 5/1974 | Hunt | 173/46 X |
| 3,873,157 | 3/1975 | Stoltefuss et al. | 299/64 |
| 3,998,493 | 12/1976 | Paural | 299/66 X |

FOREIGN PATENT DOCUMENTS

| | | | |
|---|---|---|---|
| 261,226 | 6/1913 | Fed. Rep. of Germany | 299/65 |
| 2,310,363 | 9/1974 | Fed. Rep. of Germany | 299/67 |

*Primary Examiner*—Ernest R. Purser

*Attorney, Agent, or Firm*—Brady, O'Boyle & Gates

[57] ABSTRACT

A vehicle for use in mine workings for enlarging a tunnel or for forming a heading and comprising a wheeled chassis having a rock breaker and a bucket loader mounted thereon further includes a conveyor means extending generally longitudinally of the chassis to receive rock and spoil collected by the bucket loader at the forward end of the chassis and to discharge such rock and spoil at the rearward end of such chassis. Rams are provided laterally of the chassis for supporting the same relative to opposed surfaces of the workings.

6 Claims, 3 Drawing Figures

FUNNELING MACHINE WITH INCLINED ADVANCING RAMS

The invention concerns mining and like machinery, and has more particular reference to machinery for use in enlarging tunnels and forming headings in mine workings.

In enlarging tunnels and forming headings in mine workings it is known to use a vehicle movably mounted on tracks which ordinarily exist in the tunnel and which has a generally forwardly operating rock breaker device and a bucket loader for removal of rock and spoil dislodged by the rock breaker device, the vehicle being advanced as the breaking operation progresses and the rock and spoil being transferred from the front to the rear of the vehicle along the sides and beneath the vehicle.

In such vehicles as aforesaid, in view of the limited space available at the sides of and beneath the vehicle, difficulty is experienced in satisfactorily transferring the rock and spoil, and it is an object of the invention to provide a means for facilitating this operation.

A further difficulty lies in the need firmly to locate the vehicle in a manner satisfactorily to absorb the reaction loads resulting from operation of the rock breaker device, and it is another object of the invention to provide a means for firmly locating the vehicle in an operative position.

Therefore, according to one aspect of the present invention there is proposed a vehicle for use in a mine working for enlarging a tunnel or forming a heading which comprises a chassis or like structure and a rock breaker and a bucket loader movably mounted on such chassis which is characterised by the provision of a conveyor means supported on or by the chassis, the conveyor means extending generally longitudinally of the chassis, from a position at the forward end thereof whereat the said conveyor means can receive rock and spoil collected by the bucket loader to a position at the rearward end of the chassis whereat the conveyor means can discharge rock and spoil for disposal.

In a preferred arrangement the axis of the conveyor means is inclined slightly with respect to the longitudinal axis of the chassis, the forward end of such conveyor means being spaced laterally outwardly from the side of the chassis and the rearward end thereof lying generally on the longitudinal centre line of such chassis. The conveyor means will ordinarily be upwardly and rearwardly inclined with respect to the chassis.

According to another aspect of the invention, a vehicle for use in a mine working for enlarging a tunnel or forming a heading and comprising a chassis having a rock breaker and a bucket loader mounted thereon is characterised by a plurality of rams extending laterally outwardly of the chassis for engagement with a respective opposed surface of the working.

In a preferred arrangement the individual rams of the said plurality of rams includes rams provided at the sides of the chassis to extend therefrom transversely of the chassis, such rams being pivotally secured, at their inner ends, to respective lugs provided on the chassis and their outer ends being adapted for engagement with an opposed wall surface.

The invention will now be described further, by way of example only, with reference to the accompanying drawing illustrating one embodiment thereof and in which.

Figures 1, 2:
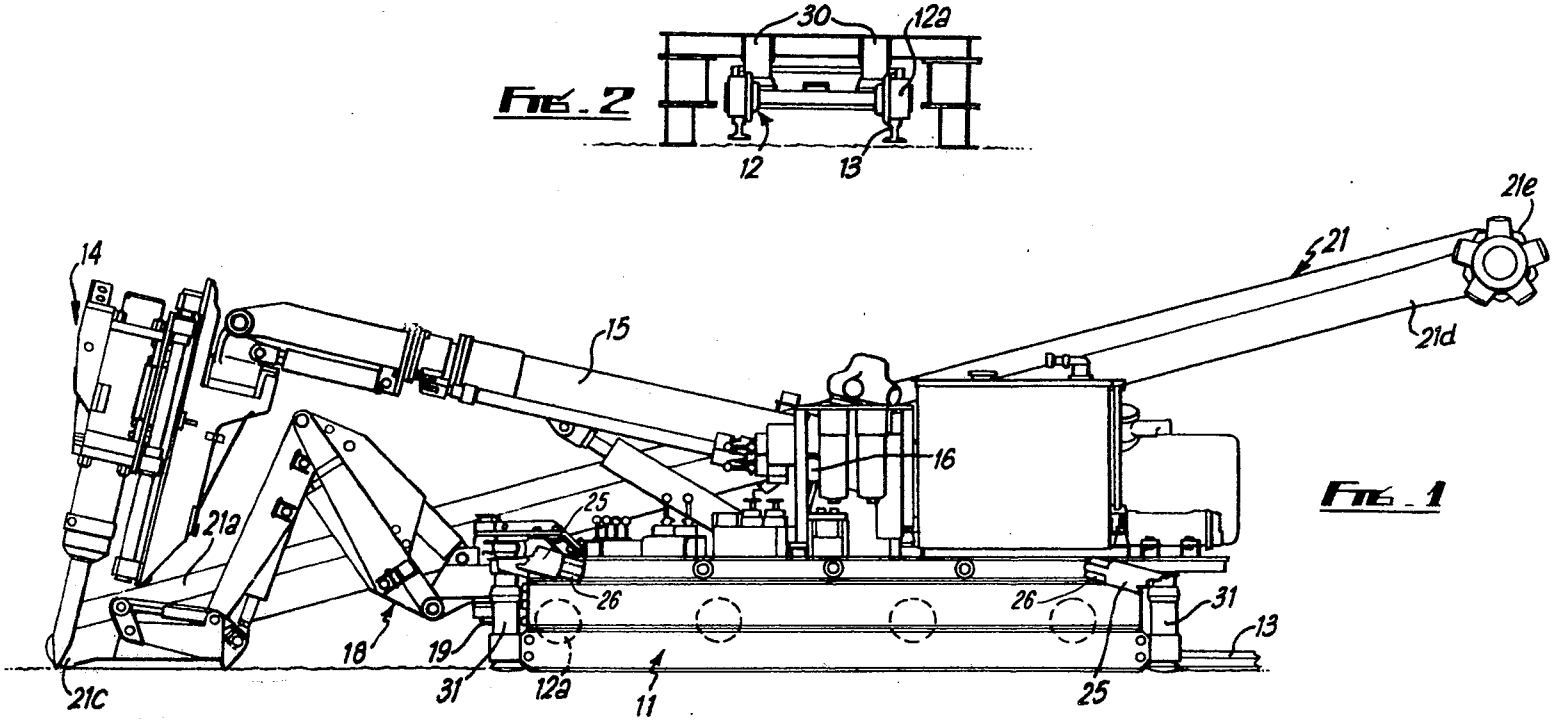
FIG. 1 is a side elevation of a mining machine constructed in accordance with the invention.
FIG. 2 is an end elevation showing the wheeled carriage and the chassis of the machine shown in FIG. 1.
Figure 3:
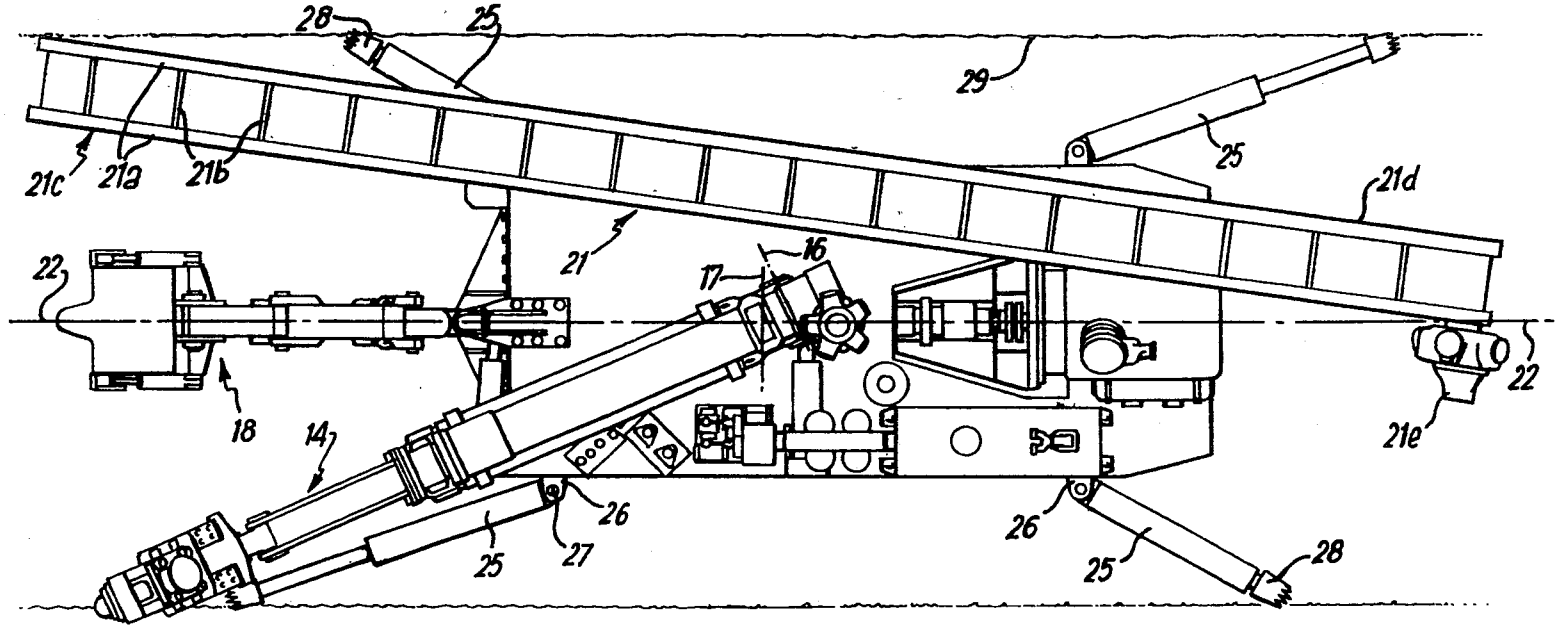
FIG. 3 is a plan view of the machine shown in FIG. 1.

Referring now to the drawing, a mining machine comprises a chassis or like structure 11 movably mounted on a wheeled carriage 12 having wheels 12*a* engaged with spaced rails 13, an impact rock breaking tool 14 supported on a boom structure 15 pivotally mounted on the structure 11 for upward and downward motion about a generally horizontal axis 16 and for lateral movement about a generally vertical axis 17, and a boom and bucket assembly 18 arranged for movement laterally of the structure 11 about a generally vertical axis 19 at the forward end of the vehicle.

The impact rock breaking tool 14 and the boom and bucket assembly 17 form no part of the present invention as such, and thus further detailed consideration thereof is not thought necessary.

In contradistinction to prior machines, and in accordance with one aspect of the present invention, the structure 11 carries an upwardly and rearwardly extending conveyor means 21, the said conveyor means 21, which conveyor means conveniently comprises a conveyor of the panzer-type which consists essentially of two endless chains 21*a* arranged in spaced parallel disposition having, at spaced intervals therealong a series of bars or flights 21*b*, being inclined in relation to the longitudinal axis 22 of the structure 11, the forward end 21*c* of the conveyor means being displaced outwardly beyond the lateral limits of the vehicle and the rearward end 21*d* lying generally on the longitudinal centre line of the structure 11. At its forward end the conveyor means extends to the sweep path of the bucket loader at a position close to the floor of the tunnel, whilst the rearward end of such means is in an elevated position beyond the back of the structure 11.

An hydraulic motor 21*e* provided for driving the conveyor means 21, such conveyor means 21 receiving and transporting rock and spoil fed thereto up the incline thereof.

In use, the bucket loader takes up material from the floor of the tunnel or working, and is used to deposit such material onto the conveyor, the material being elevated by the movement of such conveyor and eventually being discharged to a waiting skip (not shown) or other receptacle movably supported on the rails 13.

As will readily be appreciated, by providing the conveyor means in such position upon the chassis as is shown, and by effecting such adjustments as are necessary in the positions of the various structures mounted on the chassis, we are able to provide a vehicle of the kind here involved wherein transference of rock and spoil is much facilitated, thereby giving a speedier and more successful working operation.

Also in contradistinction to prior machines and in accordance with another aspect of the invention, the chassis or like structure carries a plurality of hydraulic rams for extension laterally outwardly thereof, the individual ones of the said plurality of rams being intended for engagement with an opposed wall surface of the working. Thus, two rams 25 are provided at each side of the chassis or like structure 11, the rams being pivotally mounted in respective lugs 26 secured to the chassis adjacent to the forward and rearward ends thereof for angular adjustment about the axes of securing pins 27 whereby the rams are fastened in the lugs. At its remote end, each ram carries a claw 28 for engagement with an opposed wall surface 29.

The rams at the forward end of the chassis or like structure extend upwards and outwards forwardly of the chassis, whilst those at the rearward end extend downwards and outwards rearwardly of such chassis as is apparent from the drawing.

In use, the rams 25 are extended to cause the claws at the extremities thereof to engage the opposed wall structure, such engagement serving to introduce an increased stability to the machine and to enable the same better to accommodate reaction loads arising from the operation of the impact rock breaker, it being understood that the machine will be seated on the floor of the tunnel or working, rather than being supported on the wheels, by appropriate operation of jack mechanisms provided for this purpose. The jack mechanisms for adjusting the machine between its operating and its movement conditions, in the embodiment disclosed, comprise lifting jacks 30 (see FIG. 2) at the front and rear of the chassis effective between the chassis 11 and the wheeled carriage 12 for raising or lowering such chassis 11 relative to the wheeled carriage 12 and bearing down jacks 31 (see FIG. 1) likewise at front and rear of the chassis, the bearing down jacks being secured to and depending from the chassis 11 and constituting a means for levelling such chassis, and thus the machine as a whole, to compensate for any unevenness in the floor of the mine working.

As is apparent from the drawing, and particularly from FIG. 1 thereof, in the embodiment illustrated the rams are downwardly and outwardly inclined with respect to the chassis, but other inclinations may be preferred according to the circumstances obtaining. Accordingly, provision may be made for varying the inclination of the rams.

In addition to providing a means for "staking " the machine to hold the same firmly in position in the tunnel or working, the rams can be utilised for moving the machine longitudinally of the tunnel by selectively operating those rams appropriate for effecting movement of the machine in the required direction, the machine being lifted from its seated position for support by the wheels 12 during such movement. According to the magnitude of the movement required in relation to the stroke of the rams 25, so a plurality of sequential movements from successive locations on the wall 29 may be required. If the machine is to be moved down an incline, then it may be desirable to utilise the rams at the forward (in the direction of intended movement) end of the machine to control the movement, such rams being progressively retracted to permit forward motion of the machine under the effect of gravity and/or of the progressive extension of the rams at the other end of the machine.

A still further method of effecting a controlled movement of the machine longitudinally of the rails 13 is by means of the boom 15 and breaking tool 14, the tool 14 being anchored to the work face, wall or floor, and the boom being retracted or extended, as appropriate, according to the intended direction of movement.

The invention is not restricted to the exact features of the embodiment described and illustrated, since alternatives will readily present themselves to one skilled in the art. Thus, for example, whilst the conveyor means disclosed has an upwardly and rearwardly inclined conveying surface of generally constant inclination throughout its length, other conveyor configurations may be preferred, such as, for example, an initial section which is upwardly and rearwardly inclined and which is followed by a generally horizontal section. The conveyor means need not be straight when viewed in plan, although a straight run for such means is to be preferred.

As regards the "staking" rams, whilst a machine having four such rams is contemplated, the invention is not restricted to such number. For example, two rearwardly and outwardly extending rams may be found adequate to accommodate the reaction forces from the impact rock breaker. Furthermore, whilst hydraulic rams are preferred, other pressure fluids, such as compressed air, may be used to effect ram operation.

Having thus described typical embodiments of our invention, that which we claim as new and desire to secure by Letters Patent:

1. A vehicle for use in a mine working for enlarging a tunnel or forming a heading, comprising a chassis or like structure, a percussive action rock breaker and an independently operable bucket loader movably mounted on such chassis, a conveyor means supported by the chassis, the conveyor means extending generally longitudinally of the chassis from a position at the forward end thereof whereat the said conveyor means can receive rock and spoil collected by the bucket loader to a position at the rearward end of the chassis whereat the conveyor means can discharge rock and spoil for disposal, and a plurality of rams pivotally mounted on and extending laterally outwardly of the chassis, each for engagement with a respective opposed surface of the mine working, the plurality of rams including individual rams located at the sides of the chassis at the forward and rearward ends thereof, the rams at the forward end of the chassis inclined upwardly and adapted to be extended transversely outwardly of the chassis, the rams at the rearward end of the chassis inclined downwardly and adapted to be extended transversely outwardly of the chassis, and respective claws being provided at the outer ends of the rams for engagement with an opposed wall surface, said rams thereby being adapted to impart a selective translational motion to said chassis in the forward and rearward directions on alternate extension and retraction of the rearmost or foremost rams.

2. A vehicle as claimed in claim 1, wherein the axis of the conveyor means is inclined slightly with respect to the longitudinal axis of the chassis, the forward end of the conveyor means being spaced laterally outwardly from the side of the chassis.

3. A vehicle as claimed in claim 2, wherein the rearward end of the conveyor means lies generally on the longitudinal centre line of the chassis.

4. A vehicle as claimed in claim 1, wherein the conveyor means extends beyond the chassis at the forward and rearward ends thereof.

5. A vehicle as claimed in claim 1, wherein the conveyor means is upwardly and rearwardly inclined with respect to the chassis.

6. A vehicle as claimed in claim 5, wherein the conveyor means extends beyond the chassis at the forward and rearward ends thereof and wherein the forward end of the conveyor means extends to a level generally co-planar with the plane of the underside of the chassis.

* * * * *

UNITED STATES PATENT AND TRADEMARK OFFICE

CERTIFICATE OF CORRECTION

PATENT NO. : 4,113,316

DATED : Sept. 12, 1978

INVENTOR(S) : Reginald Andrew Phillips et al.

It is certified that error appears in the above-identified patent and that said Letters Patent are hereby corrected as shown below:

Title page, and column 1, title of invention, paragraph [54]:
delete the word "Funneling" and insert the word "Tunneling".

Signed and Sealed this

*Second* Day of *January 1979*

[SEAL]

*Attest:*

RUTH C. MASON
*Attesting Officer*

DONALD W. BANNER
*Commissioner of Patents and Trademarks*